US005926148A

United States Patent [19]

Liu et al.

[11] Patent Number: 5,926,148

[45] Date of Patent: Jul. 20, 1999

[54] THREE DIMENSIONAL RECONFIGURABLE PHOTOCONDUCTIVE ANTENNA ARRAY ELEMENT

[75] Inventors: David Da-Wei Liu, Nashua, N.H.; Paul H. Carr, Bedford; Steven D. Mittleman, Framingham, both of Mass.

[73] Assignee: The United States of America as represented by the Secretary of the Air Force, Washington, D.C.

[21] Appl. No.: 08/934,013

[22] Filed: Aug. 25, 1997

[51] Int. Cl.[6] ..... H01Q 13/00

[52] U.S. Cl. ..... 343/785; 343/721; 342/368; 250/551

[58] Field of Search ..... 343/720, 721, 343/754, 783, 785; 342/368, 371; 250/550, 551, 552

[56] References Cited

U.S. PATENT DOCUMENTS

| | | | |
|---|---|---|---|
| 4,701,880 | 10/1987 | Ichihara | 365/106 |
| 5,014,069 | 5/1991 | Seiler et al. | 343/785 |
| 5,420,595 | 5/1995 | Zhang et al. | 342/368 |

*Primary Examiner*—Don Wong
*Assistant Examiner*—Tho Phan
*Attorney, Agent, or Firm*—Robert L. Nathans

[57] ABSTRACT

First and second tandemly positioned electrically biased semiconductor members radiate microwave energy in response to the receipt of an excitation light beam having two wavelengths related to the bandgaps of the members. The projected microwave beam may be made more narrow and directional if two of the members are electrically biased at the same time. An inefficient frequency doubler generates the two wavelength beam enabling a single light beam to excite both members in a simple, rugged photoconductive antenna element.

20 Claims, 2 Drawing Sheets

THREE DIMENSIONAL RECONFIGURABLE PHOTOCONDUCTIVE ANTENNA ARRAY ELEMENT

BACKGROUND OF THE INVENTION

The present invention relates to the field of phased array microwave antennas controlled by photonic components.

Enhanced mission performance and surveillance capability have greatly increased the number of function-specific electromagnetic sensors placed on platforms such as aircraft. As a result, the large number of antennas exacerbates an already critical weight and volume limitation problem, along with enhancing the unwanted stealth platform's radar signature.

Three-dimensional photoconductive antenna arrays address the critical need to include more antenna elements using fewer exposure apertures. The replacement of bulky feed lines with optical fibers for controlling the antenna elements also allow the antenna systems to be light weight, compact, and resistant to destruction by electromagnetic interference. Photoconductive antennas are unique in that the radiating elements are made of non-metallic dielectric material that minimize crosstalk or mutual coupling between antenna elements. See a paper authored by D. W. Liu and P. W. Carr, inventors of the present invention, in IEEE Photonics Technology Letters, Vol. 8, No. 6, June 1996 and incorporated by reference herein. See also Optics Letters, Vol. 20, No. 14, Jul. 15, 1995 and U.S. Pat. No. 5,420,595 to Zhang et al.

Thus, microwave energy can travel through the dielectric antenna elements in contrast with metallic elements. This property enables the unique "in line" three-dimensional dielectric antenna array elements of the present invention that can be used in compact and rugged phased array antenna configurations having a minimum of ancillary optical elements due to the use of optical wavelength multiplexing. Laser diodes may be employed for enhanced ruggedness and economy, and commercial applications appear interesting such as, for example, collision avoidance systems for automobiles or aircraft.

BRIEF SUMMARY OF A PREFERRED EMBODIMENT OF THE INVENTION

The invention utilizes generation of light pulse induced photocarriers in a semiconductor that will accelerate if a DC electric field is present, in turn resulting in the radiation of a microwave pulse from the semiconductor.

First and second tandemly positioned semiconductor members having electric fields induced therein by selectively applied voltages, are illuminated by first and second wavelengths of light, each wavelength being related to the particular bandgap of its associated semiconductor. Each semiconductor being so optically excited, will emit a microwave burst. Compact three-dimensional reconfigurable phased array photoconductive antenna arrays may be provided by varying the applied voltages, optical beam geometry, and intensity and the multiple optical wavelength combination.

Besides having the advantages enumerated herein above, including ruggedness, compactness and simplicity, the employment of multiple wavelength excitation of the two or more semiconductor members in tandem can improve the directionality of the resulting narrowed radiated microwave beam.

BRIEF DESCRIPTION OF THE DRAWINGS

Other features and advantages of the invention will become more apparent upon study of the following detailed description, taken in conjunction with the drawings in which.

DETAILED DESCRIPTION OF PREFERRED EMBODIMENTS OF THE INVENTION

Figure 1:
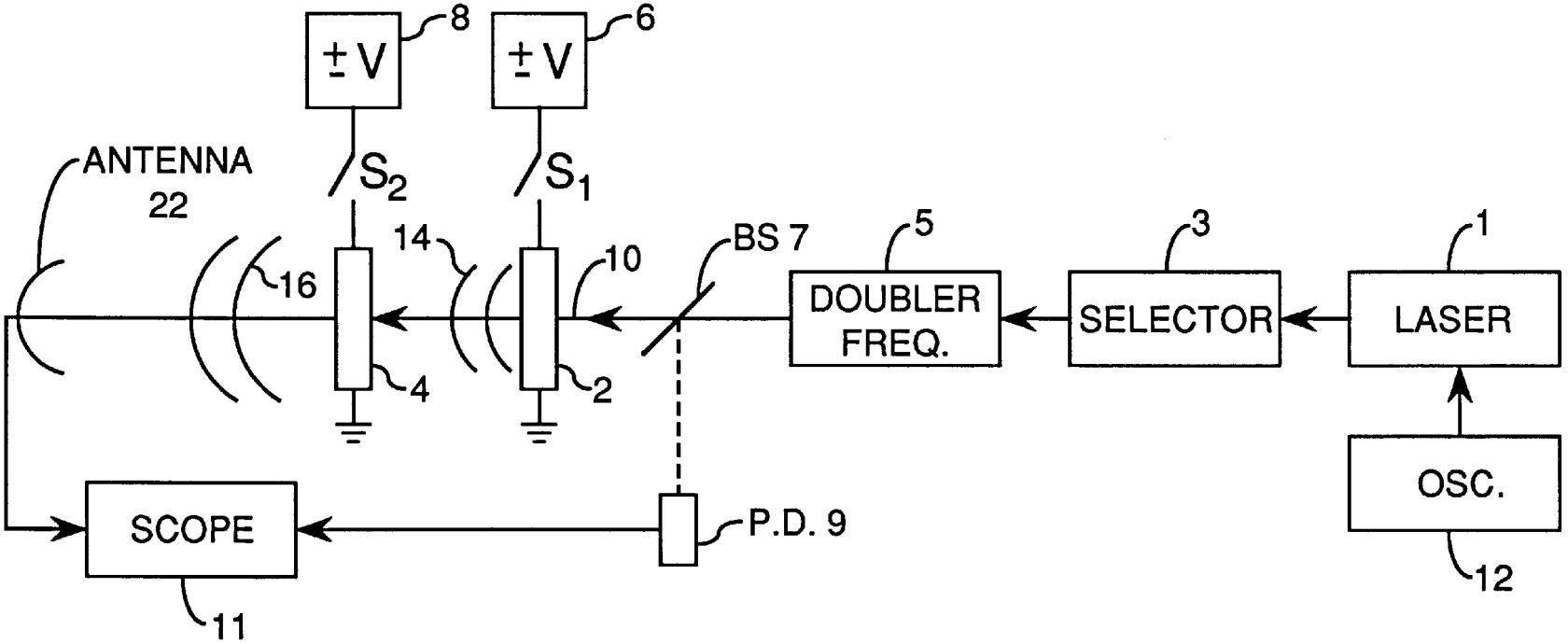
FIG. 1 illustrates a presently preferred embodiment of the invention.

FIG. 1 illustrates a serial configuration of the photoconductive array element of the invention. A first optically excited microwave radiating semiconductor member 2 is positioned in tandem with respect to a second optically excited microwave radiating semiconductor member 4 along optical axis 10. A first voltage source 6 impresses a high electric field such as twenty kilovolts/cm across semiconductor member 2 when switch S1 is closed. Likewise, a second voltage applicator 8 impresses a high voltage across the second semiconductor member 4 when switch S2 is closed. Laser 1, controlled by 38 megahertz oscillator 12, directs groups of 80 ps 1026 nm wavelength light pulse at the first semiconductor member 2 via pulse selector 3, frequency doubler 5 and optionally, beam splitter 7 which may be used for test purposes. The frequency doubler thus directs light of a first wavelength of 526 nm at the first semiconductor 2, since its input is light having a 1052 nm wavelength. The fact that the frequency doubler 5 is inefficient, beneficially results in retaining the second wavelength of 1052 nm, so that these components function as a simple light beam generator for directing light of both wavelengths at the first semiconductor 5.

Upon selective closure of switch S1, which may be synchronized with or closed before the laser pulse, the optically excited member 2 radiates microwave energy 14 in response to the first wavelength of light at 526 nm absorbed by member 2, which microwave energy 14 passes readily through the second semiconductor member 4 to be transmitted into space. The first member 2 is transparent to light of the second wavelength at 1052 nm directed at and absorbed by the second semiconductor member 4, which radiates a simultaneous microwave energy burst into space, provided that switch S2 is closed. The selective application of high voltage across the second member 4 enables production of the second microwave energy beam in response to the receipt of the second 1052 nm wavelength of light unabsorbed by and thus previously passed on by the first semiconductor member 2. Provided both switches are closed, the contribution of each optically excited member produces an enhanced microwave beam, indicated by 16, due to algebraic addition of the individual microwave fields.

The first semiconductor member 2 is preferably made of gallium arsenide which has an appropriate bandgap, enabling carrier excitation in response to the high voltage electric field along with the receipt of the 526 nm light which is absorbed by the member. The second member 4 is made of a small bandgap semiconductor such as indium phosphide, enabling carrier production in response to the applied electric field and the receipt of the 1052 nm light of the second wavelength which is absorbed by the member.

Fe and Zn doped InP with high dark resistivity exceeding $10^8$ ohm-cm was used for the second member. With the electrical biasing field within member 2, e.g. about 6 KV/cm for GaAs, the generation of the microwave signals becomes insensitive to variations of the biasing field and thus undesired cross-talk between the members is eliminated. This is especially true when the members are closely positioned in a serial configuration. For further details of the nature of these materials and the excitation thereof in a photoconducting antenna, reference may be made to the aforesaid OPTICS LETTERS publication by Liu et al., and incorporated by reference herein.

Thus, the skilled worker in the art of phased array microwave antennas will understand that a compact, light weight, three-dimensional reconfigurable photoconductive antenna array may be provided by varying the applied voltages, optical beam geometry, and intensity and the multiple optical wavelength combination.

In FIG. 1, oscilloscope 11 was coupled to a microwave receiving antenna 22 to examine the microwave bursts produced as stated above. Beamsplitter 7 and photodetector 9 were used to trigger the oscilloscope, which alternatively may be triggered by incoming microwave pulses. For further technical details relating to a proof of principle experimental configuration and field testing the resulting microwave radiation field, reference may be made to the following paper by Liu et al., describing the invention: P7AA-7, Conference Proceeding of Photonic Systems for Antenna Applications, Monterey, Calif., Jan. 17, 1997.

Figure 2:
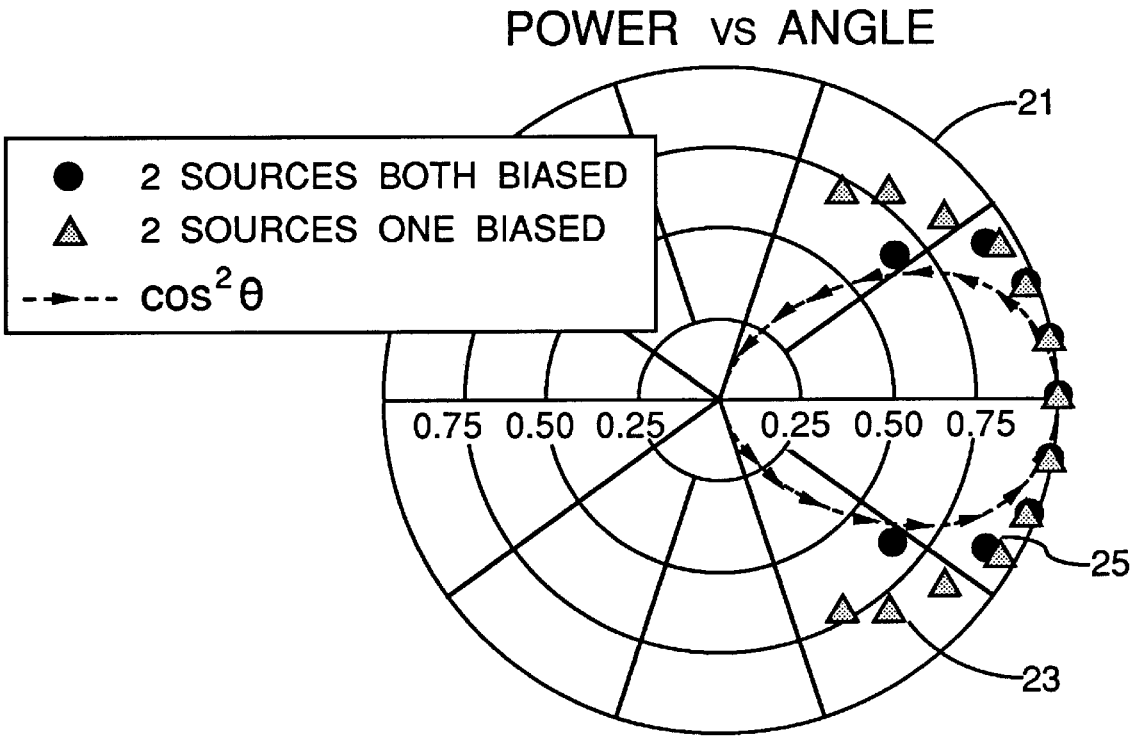
FIG. 2 illustrates the aforesaid improved directionality and narrowing of the radiated microwave beam from the antenna element.

As mentioned above, beneficial beam concentration and narrowing of the projected microwave beam will occur when both semiconductor members 2 and 4 are electrically biased by voltage sources 6 and 8. In the FIG. 2 polar plot 21 of the radiation field examined by antenna 22, the radiation pattern 23 of the radiation pattern when one member only is biased is shown, along with the radiation pattern 25 resulting from both members being biased, thus indicating beam narrowing.

Another feature of the invention provides the capability of secure, coded pulse trains. The polarity of the microwave output pulses is proportional to the voltages applied by the voltage sources 6 and 8. Thus if member 4 has a positive voltage applied thereto, and member 2 has a negative voltage applied thereto, the two pulses will cancel in the in-line direction, but will have a +v, −V "sinusoidal" shape at other directions or angles where the path lengths differ.

Variations of the aforesaid invention will be obvious to skilled workers in the art, and thus the scope of the invention is to be limited solely to the terms of the following claims and art recognized equivalents thereto. For example three or more tandemly positioned semiconductors may be provided along with several different wavelengths of light for exciting them. Additional materials may be substituted for the aforesaid semiconductors.

We claim:

1. A microwave radiating photoconductive antenna component comprising:

(a) a plurality of optically excitable microwave radiating semiconductor members;

(b) first voltage application means for applying sufficient voltage to a first microwave radiating semiconductor member to cause said first semiconductor member to radiate microwave radiation in response to the receipt of a light beam having a first wavelength related to the bandgap of the material of said first semiconductor member;

(c) second voltage application means for applying sufficient voltage to a second microwave radiating semiconductor member to cause said second microwave radiating semiconductor member to radiate microwave radiation in response to the receipt of a light beam having a second wavelength, different from said first-wavelength, and related to the bandgap of the material of said second semiconductor member; and (d) light beam generator means for directing light of said first wavelength at said first, semiconductor member and light having said second wavelength at said second semiconductor member to enable both semiconductor members to radiate microwave energy upon the application of said voltage thereto.

2. The antenna component of claim 1 wherein said light beam generator means projects light of said first and second wavelengths at said first microwave radiating semiconductor member, and wherein said first and second semiconductor members are positioned in tandem to enable light of said second wavelength to pass through said first semiconductor member and be directed at said second semiconductor member.

3. The antenna component of claim 2 wherein said light beam generator means includes an inefficient frequency doubler which provides a light beam that includes said first and second wavelengths in a simple manner.

4. The antenna component of claim 2 wherein said first semiconductor comprises gallium arsenide and said second semiconductor member comprises indium phosphide.

5. The antenna component of claim 4 wherein said light beam generator generates light having a first wavelength of 526 nanometers and a second wavelength of 1052 nanometers.

6. The antenna component of claim 2 wherein said light beam generator generates light having a first wavelength of 526 nanometers and a second wavelength of 1052 nanometers.

7. The antenna component of claim 1 wherein said light beam generator means includes an inefficient frequency doubler which provides a light beam that includes said first and second wavelengths in a simple manner.

8. The antenna component of claim 7 wherein said first semiconductor comprises gallium arsenide and said second semiconductor member comprises indium phosphide.

9. The antenna component of claim 7 wherein said light beam generator generates light having a first wavelength of 526 nanometers and a second wavelength of 1052 nanometers.

10. The antenna component of claim 1 wherein said first semiconductor comprises gallium arsenide and said second semiconductor member comprises indium phosphide.

11. The antenna component of claim 10 wherein said light beam generator generates light having a first wavelength of 526 nanometersand a second wavelength of 1052 nanometers.

12. The antenna component of claim 1 wherein said light beam generator generates light having a first wavelength of 526 nanometers and a second wavelength of 1052 nanometers.

13. A microwave radiating photoconductive antenna component comprising:

(a) a plurality of tandemly positioned optically excitable microwave radiating semiconductor members;

(b) first voltage application means for selectively applying sufficient voltage to a first microwave radiating semiconductor member to cause said first semiconductor member to radiate microwave radiation in response to the receipt of a light beam having a first wavelength related to the bandgap of the material of said first semiconductor member;

(c) second voltage application means for selectively applying sufficient voltage to a seqond microwave radiating semiconductor member to cause said second microwave radiating semiconductor member to radiate microwave radiation in response to the receipt of a light beam having a second wavelength, different from said first wavelength, and related to the bandgap of the material of said second semiconductor member; and (d) light beam generator means for directing light of said first wavelength at said first semiconductor member and light having said second wavelength at said second semiconductor member to enable both semiconductor members to radiate microwave energy upon the application of said voltage thereto.

14. The antenna component of claim 13 wherein said light beam generator means includes an inefficient frequency doubler which provides a light beam that includes said first and second wavelengths in a simple manner.

15. The antenna component of claim 14 wherein said first semiconductor comprises gallium arsenide and said second semiconductor member comprises indium phosphide.

16. The antenna component of claim 15 wherein said light beam generator generates light having a first wavelength of 526 nanometers and a second wavelength of 1052 nanometers.

17. The antenna component of claim 14 wherein said light beam generator generates light having a first wavelength of 526 nanometers and a second wavelength of 1052 nanometers.

18. The antenna component of claim 13 wherein said first semiconductor comprises gallium arsenide and said second semiconductor member comprises indium phosphide.

19. The antenna component of claim 15 wherein said light beam generator generates light having a first wavelength of 526 nanometers and a second wavelength of 1052 nanometers.

20. The antenna component of claim 13 wherein said light beam generator generates light having a first wavelength of 526 nanometers and a second wavelength of 1052 nanometers.

* * * * *